US005151073A

United States Patent [19]

Focke

[11] Patent Number: 5,151,073

[45] Date of Patent: * Sep. 29, 1992

[54] APPARATUS FOR THE PRODUCTION OF CIGARETTE PACKS

[75] Inventor: Heinz Focke, Verden, Fed. Rep. of Germany

[73] Assignee: Focke & Co. (GmbH & Co.), Verden, Fed. Rep. of Germany

[ * ] Notice: The portion of the term of this patent subsequent to Oct. 1, 2008 has been disclaimed.

[21] Appl. No.: 718,133

[22] Filed: Jun. 20, 1991

Related U.S. Application Data

[63] Continuation of Ser. No. 501,205, Mar. 29, 1990, Pat. No. 5,052,993.

[30] Foreign Application Priority Data

Apr. 5, 1989 [DE] Fed. Rep. of Germany ..... 3910986

[51] Int. Cl.[5] ..... B31B 3/14; B65B 19/02

[52] U.S. Cl. ..... 493/79; 413/74; 413/81; 413/178; 413/438; 413/910; 53/234

[58] Field of Search ..... 493/74, 79, 81, 178, 493/167, 179, 357, 438, 62, 343, 362, 361, 162, 64, 69, 910, 911; 83/100, 102, 107; 53/202, 232, 234, 383.1

[56] References Cited

U.S. PATENT DOCUMENTS

| | | | |
|---|---|---|---|
| 2,814,240 | 11/1957 | Kuchler et al. . | |
| 3,373,663 | 4/1967 | Heim . | |
| 3,379,364 | 4/1968 | Pilger . | |
| 4,037,500 | 7/1977 | Vatin . | |
| 4,084,393 | 4/1978 | Focke . | |
| 4,121,506 | 10/1978 | Van Grouw . | |
| 4,140,258 | 2/1979 | Gray . | |
| 4,151,699 | 5/1979 | Focke et al. | 493/363 X |
| 4,213,362 | 7/1980 | Focke . | |
| 4,236,663 | 12/1980 | Krautter et al. . | |
| 4,385,479 | 5/1983 | Focke | 493/363 X |
| 4,898,569 | 2/1990 | Focke et al. | 493/363 X |
| 4,918,908 | 4/1990 | Focke et al. | 53/202 X |
| 4,929,226 | 5/1990 | Focke et al. | 493/362 X |

FOREIGN PATENT DOCUMENTS

| | | |
|---|---|---|
| 1172105 | of 1964 | Fed. Rep. of Germany . |
| 2840850 | 4/1979 | Fed. Rep. of Germany . |
| 8002296 | 1/1980 | Fed. Rep. of Germany . |
| 8200355 | 9/1982 | Fed. Rep. of Germany . |
| 3536791 | 4/1987 | Fed. Rep. of Germany . |
| 3716897 | 12/1988 | Fed. Rep. of Germany . |
| 3735674 | 5/1989 | Fed. Rep. of Germany . |
| 3738102 | 5/1989 | Fed. Rep. of Germany . |
| 2409197 | 6/1979 | France . |

*Primary Examiner*—Bruce M. Kisliuk
*Assistant Examiner*—John A. Marlott
*Attorney, Agent, or Firm*—Sughrue, Mion, Zinn, Macpeak & Seas

[57] ABSTRACT

In the production of (cigarette) packs of the hinge-lid type, supplying a sufficient amount of material to the packaging machine presents a particular problem. In an advantageous solution, blanks (20) for producing the packs are severed from a continuous web of material (24) with punchings for delimiting the blanks (20) and further processed within the packaging machine. For the efficient production of (individual) blanks from the continuous web of material (24), the latter is fed to a blank station (26), in which preferably two respective blanks (20*a*, 20*b*) lying next to one another are severed by shearing from the following web of material (24) and from one another by means of severing rams (29). The two blanks (20*a*, 20*b*) so formed and individually separated are then fed to a folding turret (40), specifically appropriately with an intermediate conveyor in the form of a rotating blank turret (43) being interposed. The blank turret (43) is appropriately designed so that by means of rams (45, 46) movable in the radial direction or downwards the blanks are lifted off from the blank turret (43) and, at the same time being partially folded, can be introduced into turret pockets (41, 42) of the folding turret (40).

16 Claims, 10 Drawing Sheets

APPARATUS FOR THE PRODUCTION OF CIGARETTE PACKS

This is a continuation of application Ser. No. 07/501,205, filed Mar. 29, 1990 now U.S. Pat. No. 5,052,993.

BACKGROUND OF THE INVENTION

The invention relates to a process for the production of (cigarette) packs from blanks which are fed as a web of material and are joined together within this by means of part connections (residual connections) and which, after being severed from the web of material, are fed to a folding member, especially a folding turret, and are then folded and filled. The invention relates, furthermore, to an apparatus for the production of (cigarette) packs.

In practice, (cigarette) packs of the hinge-lid type are produced from blanks consisting of thin cardboard blanks which are prefabricated at the factory and which are supplied to the packaging machine in stacks. It has already been proposed to process blanks of thin cardboard in the packaging machine as a continuous web of material, the blanks being joined together by means of severable residual connections. The separation of the blanks takes place within the packaging machine (German Patent Application P 37 16 897.5), corresponding to U.S. Pat. No. 4,898,569.

SUMMARY OF THE INVENTION

The invention is aimed, above all, at the use of the above-mentioned webs of material with part punchings between adjacent blanks. However, webs of material of another kind, for example made of paper, can also be used.

The object on which the invention is based is to provide process-related and apparatus-related measures by which it is possible, in conjunction with a packaging machine, to process the webs of material consisting of joined-together blanks efficiently for the production of individual blanks and for the further processing of these to form a pack.

To achieve this object, according to the invention the process mentioned in the introduction is characterized in that the blanks are severed by shearing from the web of material in the direction transverse relative to the plane of these and are fed to the folding turret in the severing direction.

Whereas, in the older proposal, the blanks are severed from the web of material for further processing by tearing off, particularly as a result of a pulling movement in the plane of the latter, according to the invention a shearing stress is provided for severing the blanks.

To carry out the severing operation, according to the invention there is a severing member which is movable up and down and which causes the severance of the blanks by means of shearing edges as a result of a relative movement in relation to stationary counter-edges. The blanks are at the same time fed to the folding turret or to a preceding intermediate conveyor. This is designed as an intermittently rotating (blank) turret which conveys the individual blanks into a position opposite a pocket of the folding turret.

Preferably, during each shearing stroke two blanks are severed from the web of material and from one another simultaneously. For this purpose, the apparatus (packaging machine) is designed for a two-track mode of operation.

According to a further feature of the invention, the blanks or parts of these are (pre)folded within the joined-together web of material, preferably during the transport of the web of material in a folding track. Parts of the blanks are therefore already folded when they are severed from the web of material Further features of the invention relate to the design and arrangement of the severing members for the blanks and to devices for the conveyance and storage of these.

BRIEF DESCRIPTION OF THE DRAWINGS

The process according to the invention and exemplary embodiments of the apparatus are explained in detail below by means of the drawings In these.

DETAILED DESCRIPTION OF PREFERRED EMBODIMENTS

Figure 1:
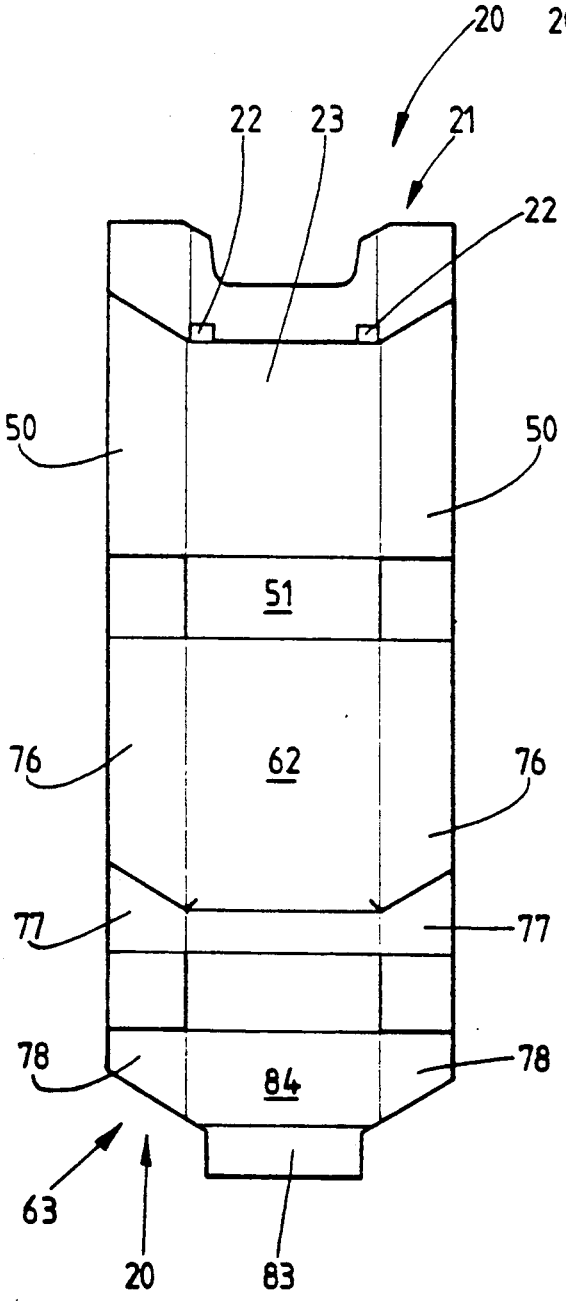
FIG. 1 shows a blank for the production of (cigarette) packs in an initial form.

The exemplary embodiments of the drawings relate to the processing of blanks 20 for the production cf hinge-lid packs to receive cigarettes. The blanks 20 have a special feature insofar as a collar 21 conventional in packs of this type is connected in one piece to the blank 20. The design of the blank 20 is described in detail in German Patent Specification 2,861,346. According to this, the collar 21 is connected to a front wall 23 of the blank 20 via lateral webs 22. To make the pack, it is necessary to shift the collar 21 relative to the blank 20 into an offset position, in such a way that, with the webs 22 folded in a Z-shaped manner, the collar 21 rests against the inner face of the front wall 23. The collar 21 now has the necessary relative position.

Figure 8:
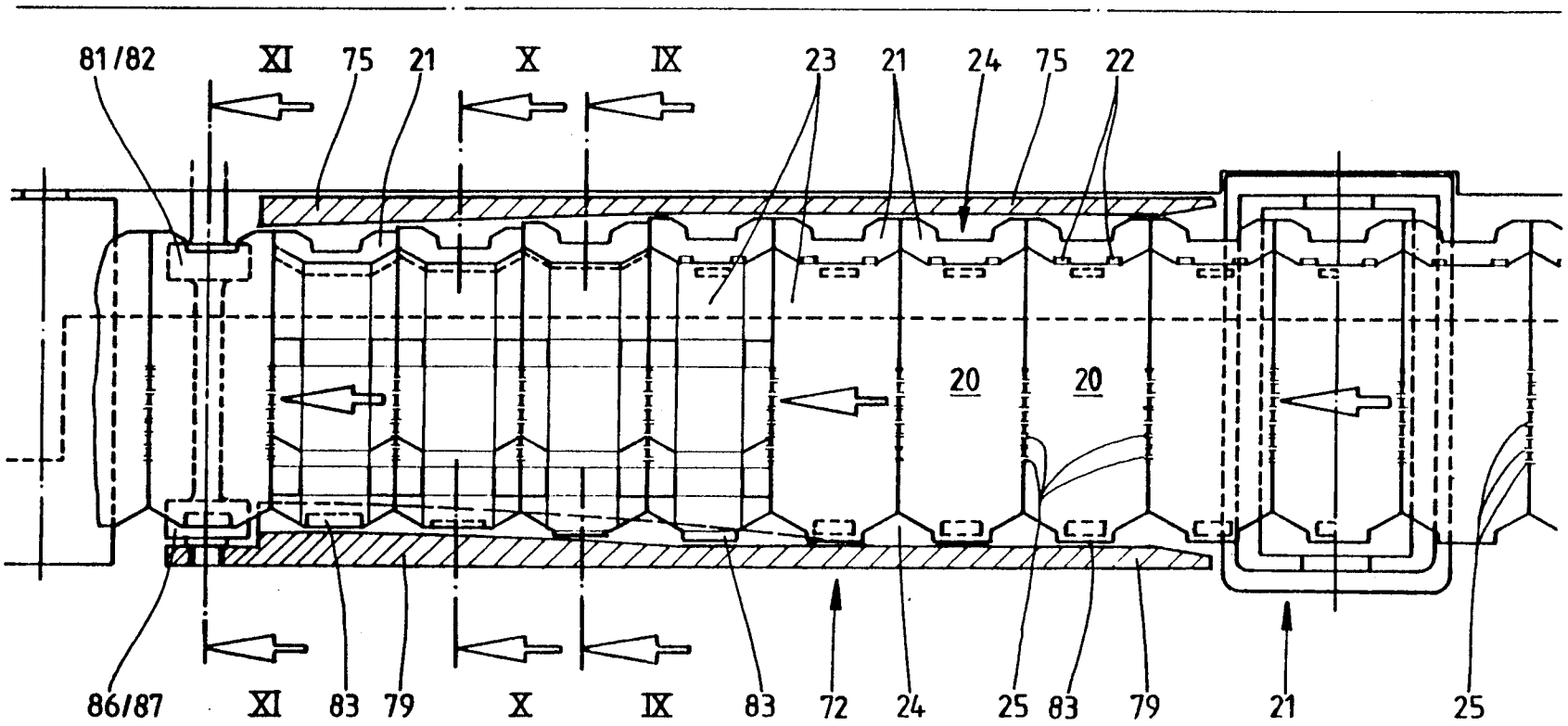
FIG. 8 shows a further detail of the apparatus according to FIGS. 3 and 4, namely a folding track, in horizontal projection or in horizontal section.

A particular feature important for the concept of the apparatuses (packaging machines) illustrated is that blanks 20 consisting of thin cardboard, before being processed to form a pack, are connected to one another in the region of their longitudinal edges so as to produce a continuous web of material 24. The blanks 20 are therefore oriented within this web, transverse relative to the longitudinal extension of the web of material 24 (see especially FIG. 8).

To form the web of material 24, the blanks 20 are connected to one another not over the complete length of the side edges, but merely via residual connections 25 in a selected middle region of the blanks 20. Outside these residual connections 25, the blanks 20 are separated from one another, even within the web of material 24, by means of appropriate punchings. The design of the blanks 20, with the exception of the collar, and of the web of material corresponds to that according to U.S. Pat. No. 4,498,569.

For further processing, the blanks 20 fed continuously as a web of material 24 to the packaging machine must be separated from one another, so that individual blanks 20 are provided. The blanks 20 are severed from the web of material 24 by shearing. The blank 20 to be severed is moved by means of an appropriate severing tool in a plane transverse relative to the next following blank 20 of the web of material 24, as a result of which this shearing operation takes place.

The separation into individual blanks 20 is carried out in the region of a blank station 26. In this, the web of material 24 is conveyed via feed rollers 27 in a horizontal plane in the region of severing members 28.

The severing members 28 consist essentially of a severing ram 29 with two ram plates 30, 31. Each ram plate 30, 31 serves for severing one blank 20*a*, 20*b*. In the present exemplary embodiment, therefore, two blanks 20*a*, 20*b* are severed from the web of material 24 and from one another simultaneously. For this purpose, the severing ram 29 which is movable up and down is assigned laterally a stationary horizontal counterplate 32 with shearing edge 33. A stationary thin-walled shearing web 34 is arranged in the middle region between the two ram plates 30, 31 and therefore centrally in the region between the two adjacent blanks 20*a*, 20*b*.

During the downward movement of the severing ram 29, first of all the severance between the two blanks 20*a*, 20*b* on the one hand and the web of material 24 on the other hand is brought about by means of the ram plate 31 assigned to the web of material 24 and therefore to the counterplate 32 and having a lateral severing edge 35. Simultaneously or immediately thereafter, as a result of the further downward movement the two blanks 20*a*, 20*b* are severed from one another by means of the shearing web 34, the latter passing through between the two ram plates 30, 31.

The ram plates 30, 31 are equipped with suction bores 36 which open out on the underside and by means of which the blanks 20*a*, 20*b* are fixed to the ram plate 30, 31 as a result of a vacuum.

Figure 3:
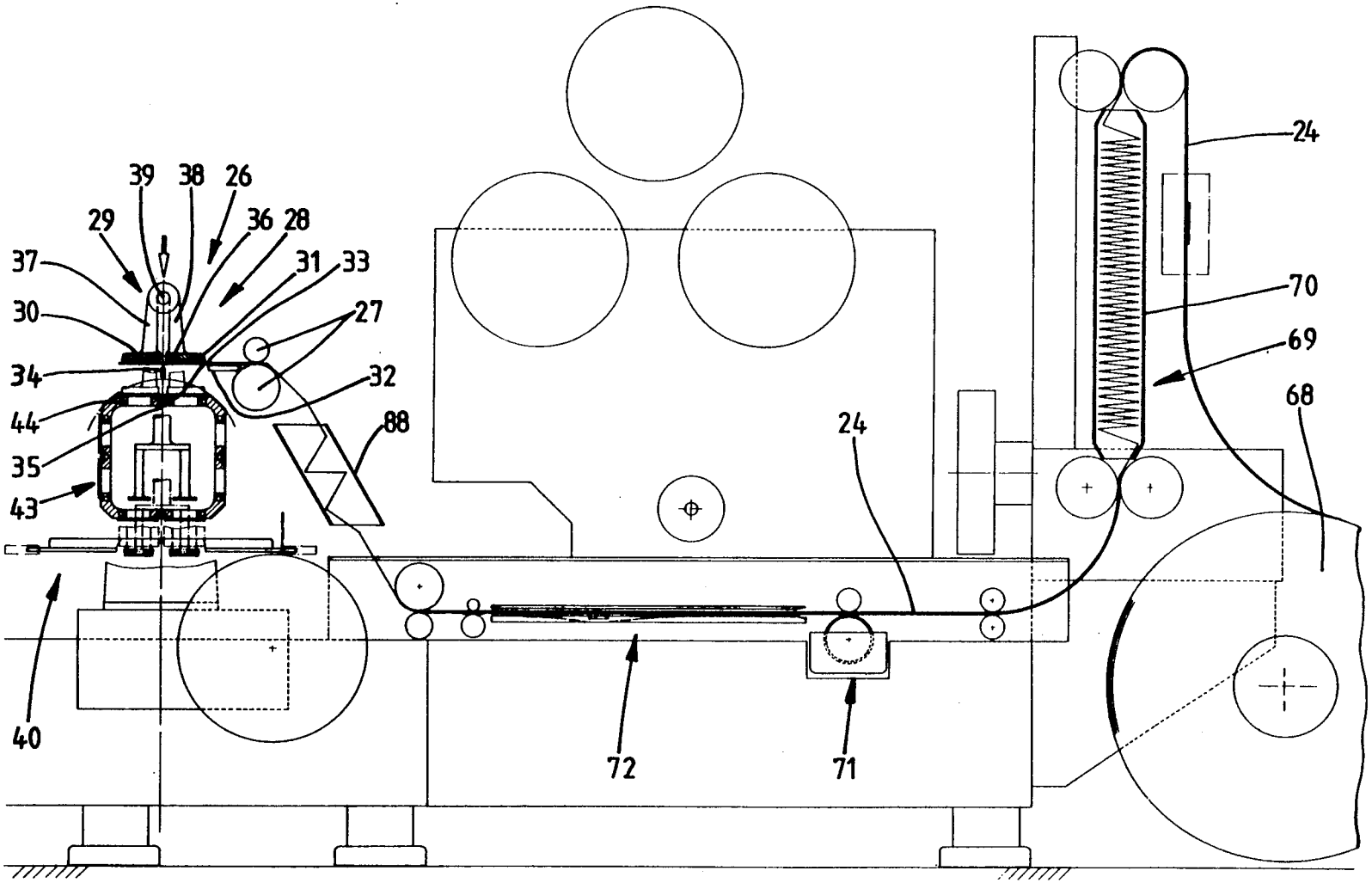
FIG. 3 shows a diagrammatic side view of an apparatus (packaging machine) for the production of (cigarette) packs.
Figure 4:
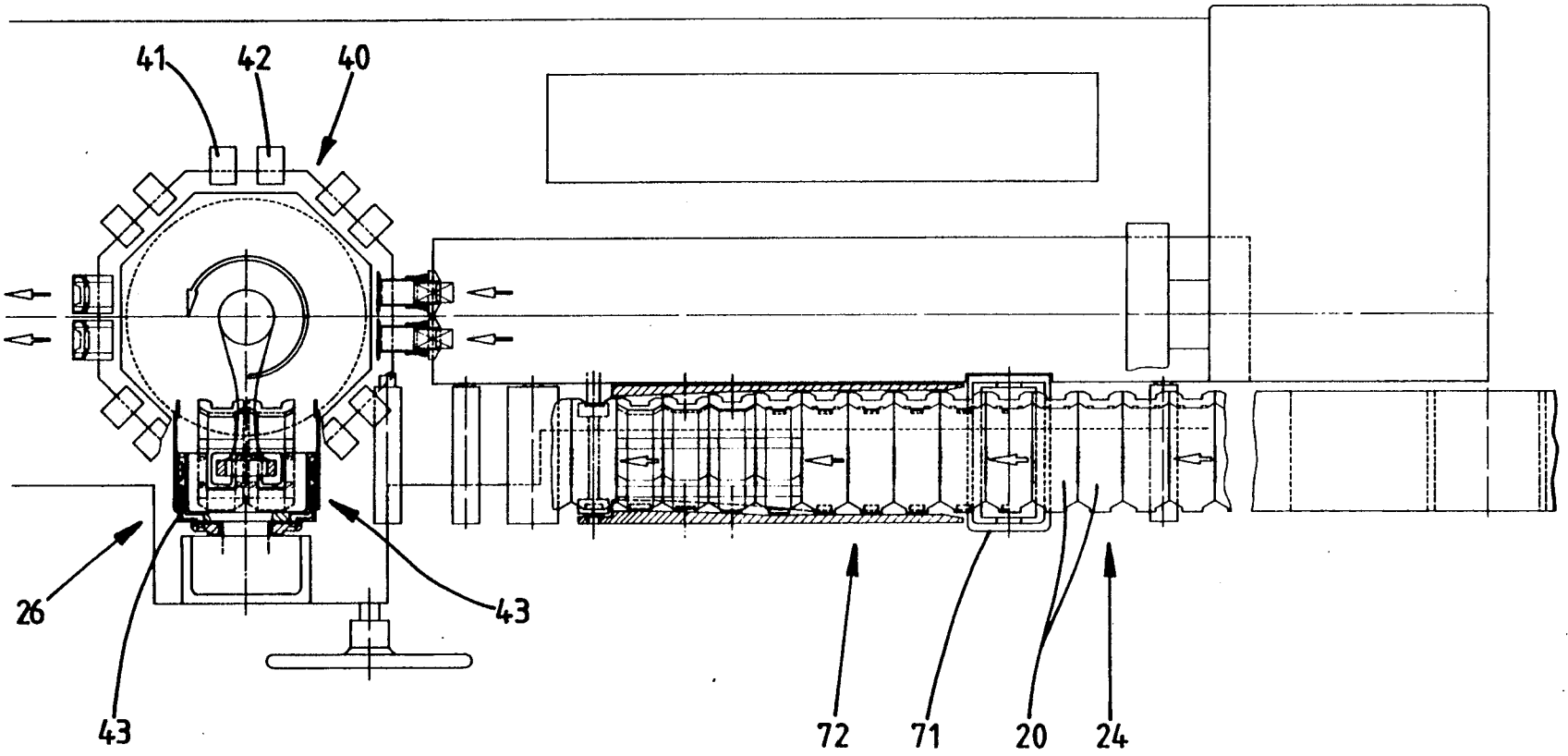
FIG. 4 shows a representation of the packaging machine according to FIG. 3 as a horizontal projection.
Figure 5:
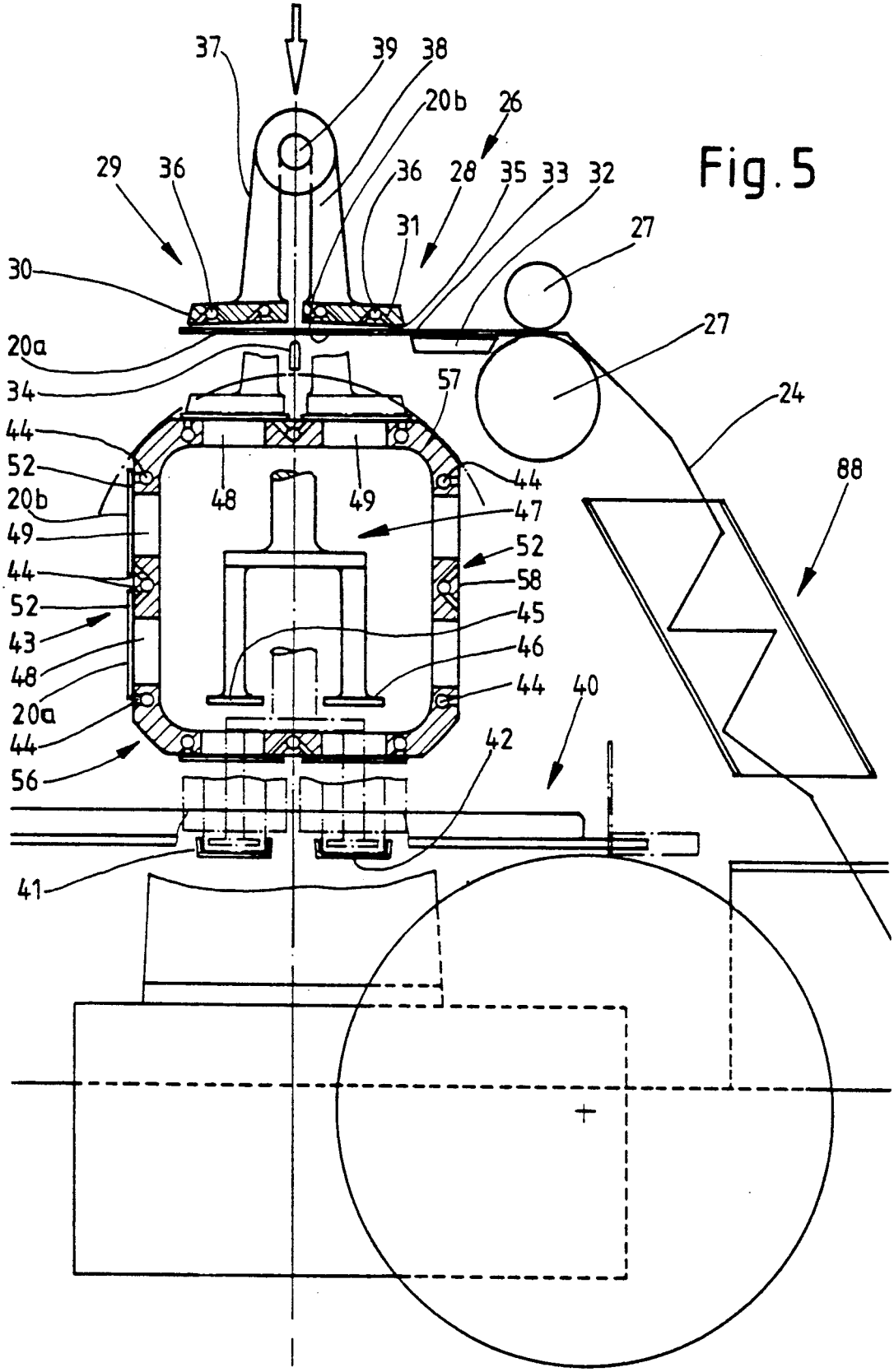
FIG. 5 shows a detail of the apparatus according to FIG. 3 on an enlarged scale, namely a blank station, partially in vertical section.
Figure 6:
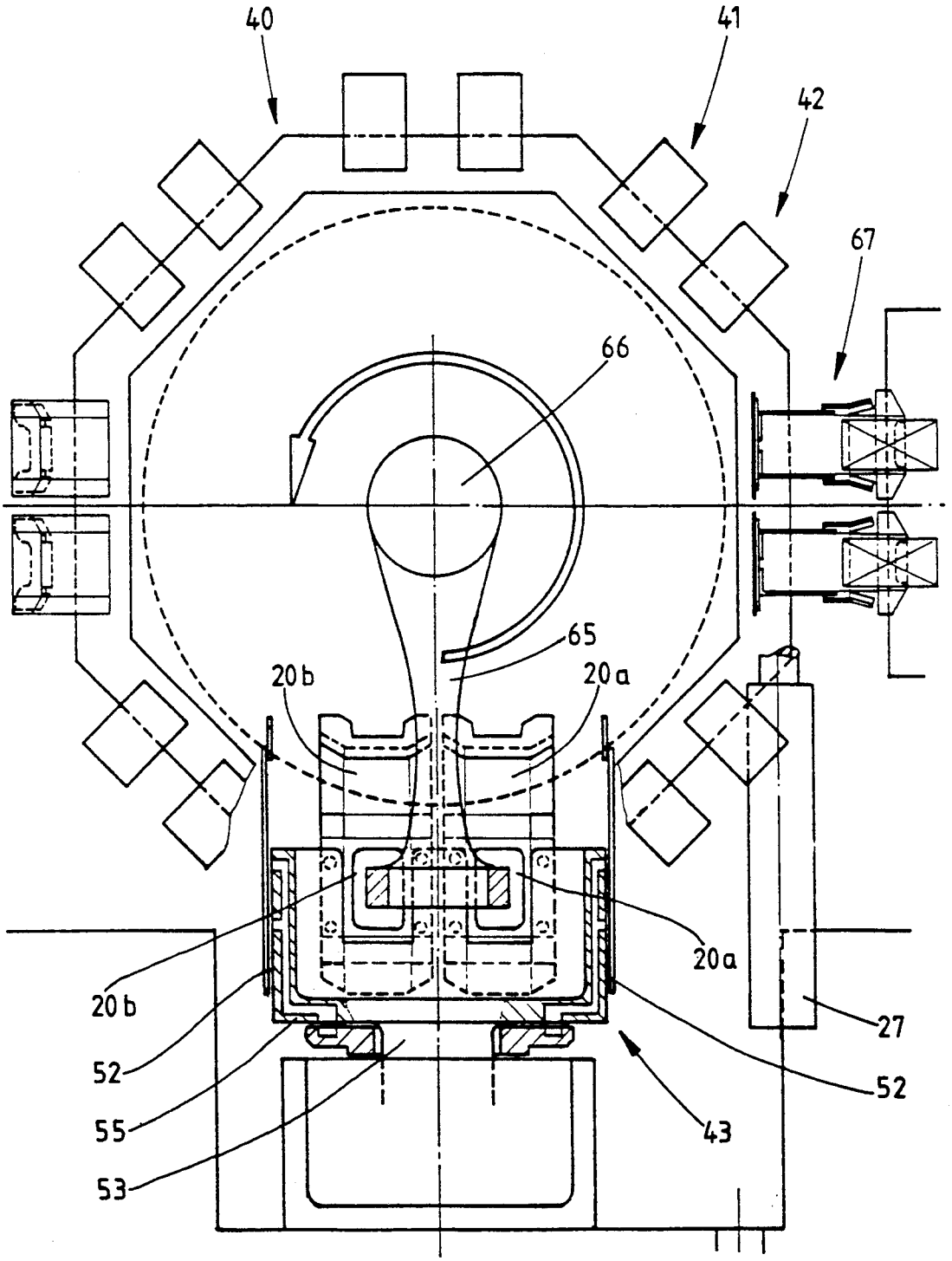
FIG. 6 shows a horizontal projection of the detail according to FIG. 5.
Figure 7:
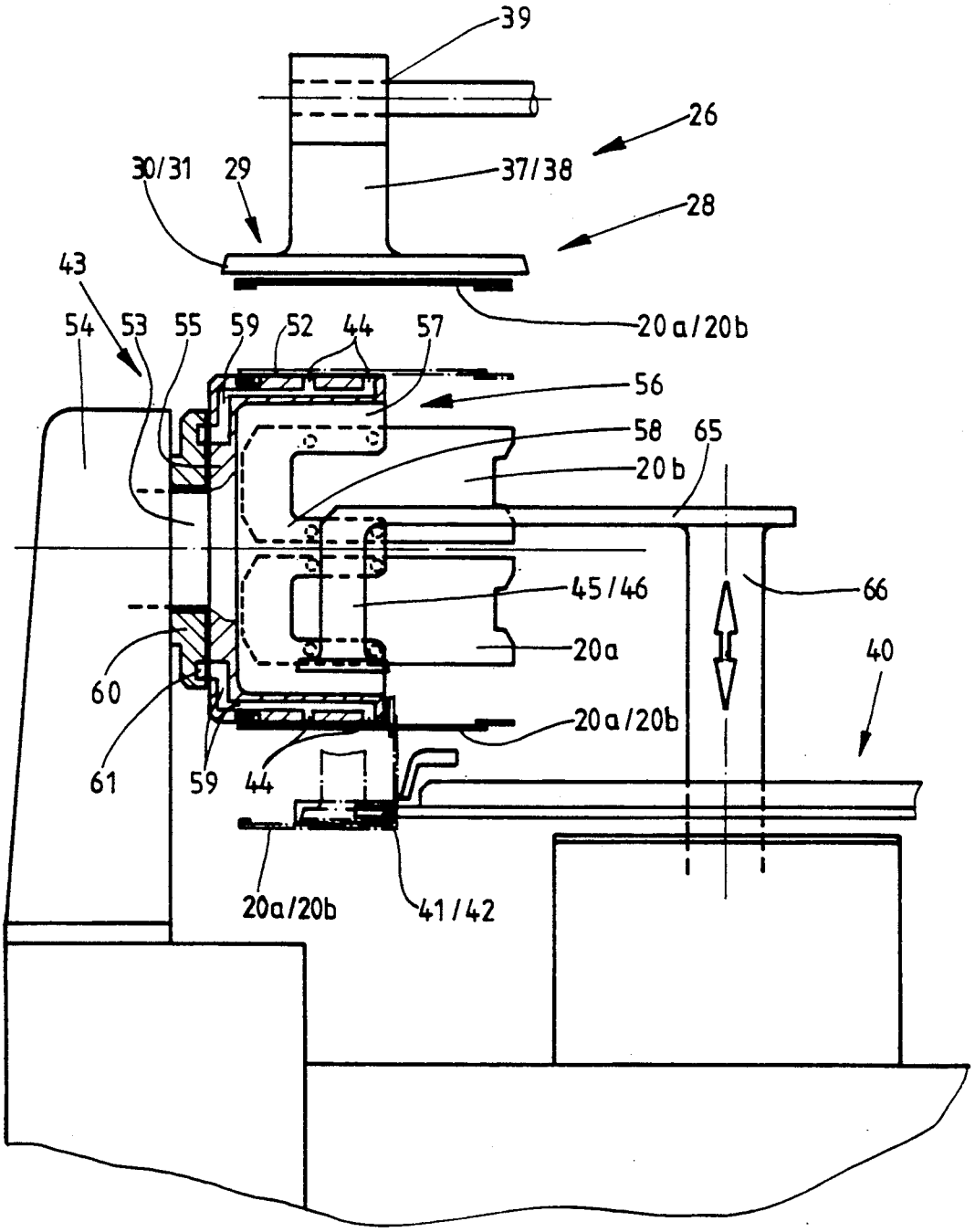
FIG. 7 shows a vertical section, transverse relative to FIG. 5, in the region of the blank station.

Furthermore, the ram plates 30, 31 are movable relative to one another in the transverse direction. For this purpose, each ram plate 30, 31 is mounted on a carrier arm 37, 38. These are connected to one another in a common pivot bearing 39. In the initial position (unbroken lines in FIGS. 3 and 5), the ram plates 30, 31 are at a small distance from one another. The position of the carrier arms 37, 38 ensures that the outer edges, severing edge 35, of the ram plates 30, 31 are inclined slightly downwards and thus assume a shearing position. After the blanks 20*a*, 20*b* have been severed from the web of material 24 and from one another, the ram plates 30, 31 are moved apart from one another slightly, so that the two blanks 20*a*, 20*b* assume a distance from one another necessary for further processing.

The blanks 20 are to be further processed in a two-track mode of operation, namely fed to a folding turret 40. Which is made rotatable about a vertical axis and plate-like (analogously to German Patent Specification 2,440,006). The folding turret 40 is equipped respectively with upwardly open turret pockets 41, 42 arranged in pairs. The blanks 20 are pressed into these from above, with blank parts at the same time being folded (erected).

For transferring the blanks 20*a*, 20*b* severed from one another and from the web of material 24 to the folding turret 40, there is as an intermediate conveyor an intermittently rotating blank turret 43 rotatable about a horizontal axis. The two blanks 20*a*, 20*b* brought to a distance from one another are laid against the circumference of this and held by means of suction air via suction bores 44. The feed of the web of material 24 takes place above the blank turret 43 in a horizontal plane. The blanks 20*a*, 20*b* severed from the web of material 24 and from one another are fed by the ram plates 30, 31 on the top side of the blank turret 43 to the circumference of the latter and laid against this. The suction bores 36 of the ram plates 30, 31 are at the same time ventilated and the suction bores 44 of the blank turret 43 subjected to suction air.

The blanks 20*a*, 20*b*, resting against the blank turret 43, are conveyed, as a result of the intermittent rotation of the blank turret 43, into such a position above the folding turret 40 that the blanks 20*a*, 20*b* now located on the underside of the blank turret 43 are aligned in. exact relative position with two turret pockets 41, 42. During a stationary phase of the blank turret 43, the blanks 20*a*, 20*b* are lifted off from this and as a result of a downward movement introduced into the upwardly open turret pockets 41, 42.

The transfer of the blanks 20*a*, 20*b* to the folding turret 40 takes place by means of transfer rams 45, 46 of a double ram 47. This is mounted within the blank turret 43 designed as a hollow body and is movable up and down. During the downward movement of the double ram 47 into the lower position represented by dot-and-dashed lines in FIG. 5, the transfer rams 45, 46 pass through recesses 48, 49 of the blank turret 43, thereby taking up the blanks 20*a*, 20*b* covering these recesses 48, 49.

The blanks 20*a*, 20*b* are pressed into the turret pockets 41, 42 by the transfer rams 45, 46, parts of the blanks 20*a*, 20*b* being folded into a vertical position, namely (outer) side tabs 50 and a blank part which consists of a bottom wall 51, front wall 23 and blank parts attached thereto, including collar 21. The transfer rams 45, 46 thereafter return into the upper initial position within the blank turret 43.

In the exemplary embodiment discussed here, the blank turret 43 is of polygonal design. Four plane bearing faces 52, against each of which two blanks 20*a*, 20*b* bear, are formed. The bearing faces 52 are either in a horizontal (upper or lower) position or in a vertical position.

In the present exemplary embodiment, the blank turret 43 is designed as a pot-like hollow body which is carried and driven by a horizontal shaft journal 53 projecting on one side. The latter is mounted on a vertical carrier part 54 of the machine stand.

The shaft journal 53 is connected to a turret disc 55 extending in the vertical plane. There extends from the edge of the latter a turret casing 56, against the outer face of which the blanks 20*a*, 20*b* bear. The turret casing 56 is made polygonal and is open on the side located opposite the turret disc 55.

The recesses 48, 49 are formed in the turret casing 56, specifically as clearances open on one side. Formed between the recesses 48, 49 are carrier webs 57, 58 which as part of the turret casing 56 limit the recesses 48, 49. The carrier webs 57 are respectively located at the "corners" of the blank turret 43 of approximately square cross-section. The carrier webs 58 are located in the middle region of a bearing face 52. The carrier webs 57, 58 are equipped with suction bores 44. These are connected to a vacuum source via suction channels 59 and a stationary segment disc 60 with suction channel 61. The segment disc 60 is attached concentrically relative to the shaft journal 53.

In the present exemplary embodiment, the dimension of the turret casing 56 in the axial direction is such that only those regions of the blanks 20*a*, 20*b* to be pressed into the turret pockets 41, 42 bear against the turret casing 56 or the carrier webs 57, 58. These are a rear wall 62, (inner) side tabs 76 adjoining this and blank parts for forming a lid 63 of the pack. Above all the lateral parts of the blanks 20*a*, 20*b*, namely the side tabs 76 and lid side tabs 77 and 78, bear against the turret casing 56 or against the carrier webs 57, 58 and are held by means of suction bores 44.

The double ram 47 penetrates from the open side of the blank turret 43 into the interior of the latter or into the turret casing 56. The double ram 47 is mounted laterally, particularly outside the region of the blank turret 43, via an actuating arm 65 on an actuating rod 66 movable up and down.

The blanks 20*a*, 20*b* introduced into the folding turret 40 are filled in successive stations and ready-folded until a pack (hinge-lid pack) is formed. In a filling station 67, the pack content, in particular a cigarette group wrapped in an inner blank, is pushed into the partially folded blank 20*a*, 20*b*.

The web of material 24 can be fed to the blank station 26 in various ways. In the exemplary embodiment of FIG. 3, the web of material 24 is drawn off from a wound reel 68. The web of material 24 then runs through a web store 69, in which a material stock is formed, specifically as a result of the zigzag-shaped folding together of the web of material 24. Bending points are formed respectively between successive blanks 20, that is to say in the region of the residual connections 25. A concertina-like structure with a relatively large stock of blanks 20 is thereby obtained. This stock is located inside a storage housing 70 of rectangular cross-section. This is arranged vertically. The web of material 24 is drawn out of the storage housing 70 at the lower end and t the same time shaped into the plane form once again.

The capacity of the web store 69 is selected so that sufficient material is available for the continued operation of the packaging machine during the exchange of an emptied reel 68 for a full one.

After coming out of the web store 69, the web of material 24 is deflected into a horizontal plane. At the same time, the web of material 24 runs through a glue unit 71. This consists conventionally of glue rollers and of a glue vessel for applying glue spots to the blanks 20.

A folding track 72 likewise extending horizontally then follows. In the region of this, a part folding of the blanks 20 within the web of material 24 takes place, with the latter at the same time being transported continuously. On the one hand, in the region of the folding track 72 the collar 21 is folded out of the extended initial position according to FIG. 1 into the relative position suitable for the pack according to FIG. 2. For this, a relative movement of the collar 21 in the direction of the front wall 23 of the blank 20 is necessary, the webs 22 at the same time being folded in a Z-shaped manner.

This folding operation is carried out by means of fixed folding members of the folding track 72, along which the parts of the blank 20 which are to be folded slide during transport For this purpose, the folding track 72 consist essentially of an upper guide 73 and of a lower guide 74. The web of material 24 is transported between these guides 73, 74 which are arranged at a small distance from one another. A lateral folding edge 75 serves for the bearing of the collar 21. This slides along on the folding edge 75. A counter-edge 79 extends along the folding track 72 on the opposite side. The end of the blanks 20 or of the web of material 24 located opposite the collar 21 is supported on this counter-edge 79. In this exemplary embodiment, folding edge 75 and counter-edge 79 are formed on the upper guide 73 which is itself connected to a lateral cheek 80 of the machine stand.

Figure 2:
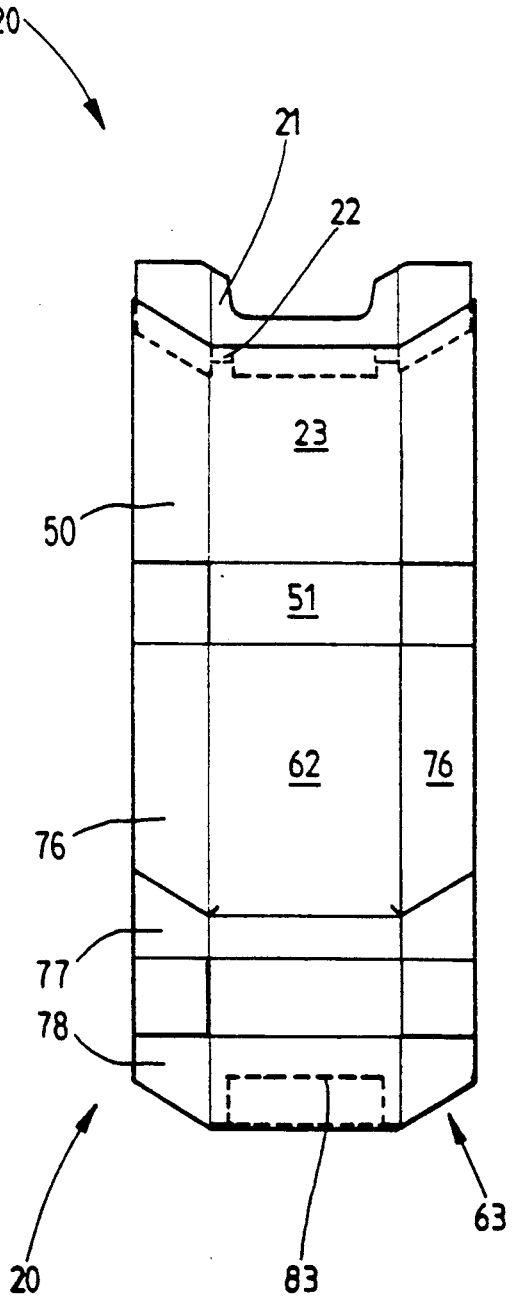
FIG. 2 shows the blank according to FIG. 1 after a part folding of this.

The shape of the folding edge 75 changes along the conveying zone within the folding track 72, in such a way that the collar 21 is increasingly shifted out of the initially extended position according to FIG. 1 into the offset position according to FIG. 2. When this position is reached, the web of material 24 leaves the region of the folding track 72 defined by folding edge 75 and counter-edge 79. The folding position of the collar 21 according to FIG. 2 is stabilized by means of upper and lower pressure rollers 81, 82.

Figure 9:
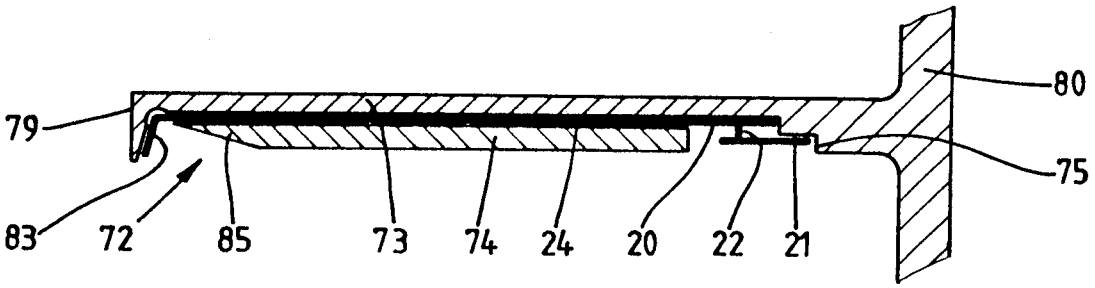
FIG. 9 shows a cross-section through the folding track of FIG. 8 in the sectional plane IX—IX.
Figure 10:
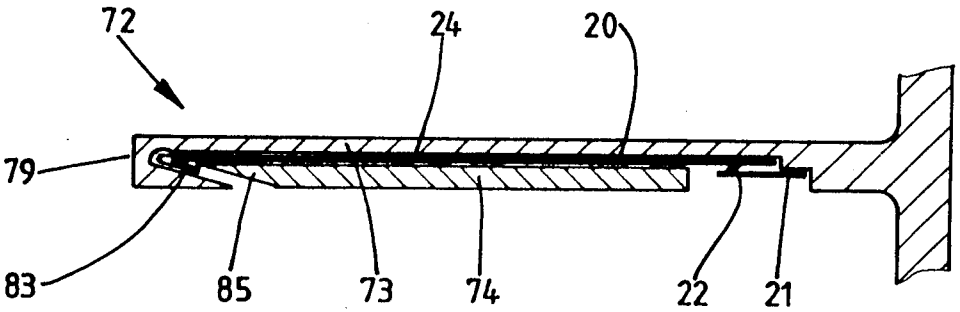
FIG. 10 shows a section in the plane X—X of FIG. 8.
Figure 11:
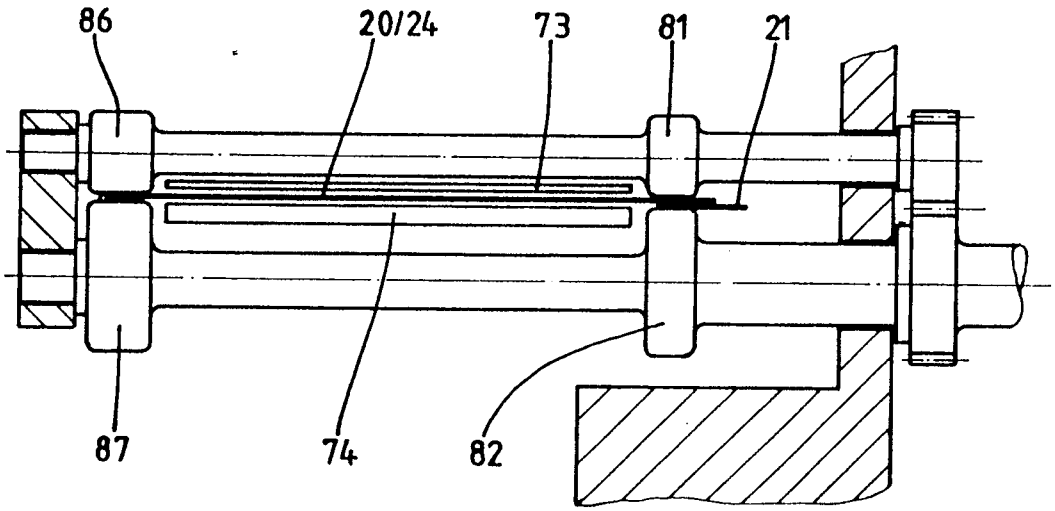
FIG. 11 shows a section in the plane XI—XI of FIG. 8.

The counter-edge 79 for supporting the web of material 24 likewise has the function of a folding member. During the transport of the web of material 24, an inner tab 83 arranged on the side of the blank 20 located opposite the collar 21 is folded continuously out of the extended initial position according to FIG. 1 up against the inner face of the blank 20, namely a lid front wall 84. For this purpose, the counter-edge 79 is designed so that it is deformed out of a flat extended position via a vertical downwardly directed intermediate position (FIG. 9) into an inwardly directed acuteangled position (FIG. 10) over the length of the conveying zone of the web of material 24. The lower guide 74 is designed with a bevelled edge 85 on the side facing the counter-edge 79, so as, in the final phase of the folding operation, to provide for the inner tab 83 a gap in which the inner tab 83 folded at an acute angle is received. This continuous folding of the web of material 24 is also subsequently stabilized by means of further pressure rollers 86, 87 which are arranged on the same shafts as the pressure rollers 81, 82.

The web of material 24 prepared in the foregoing way by means of part folds arrives via a compensating store 88 at the blank station 26. This is located in a plane offset vertically in relation to the folding track 72. The compensating store 88, made (rectangular) as a square tube in cross-section, is located in an obliquely directed arrangement in the region between blank station 26 and folding track 72.

Within the compensating store 88, a store is constantly formed as a result of the temporary zigzag folding of the web of material 24 and has the function of ensuring the transition from the continuous conveyance of the web of material 24 in the region of the folding track 72 to the intermittent transport in the region of the blank station 26. The zigzag form of the web of material 24 varies continuously (see two positions in FIG. 13).

Figure 12:
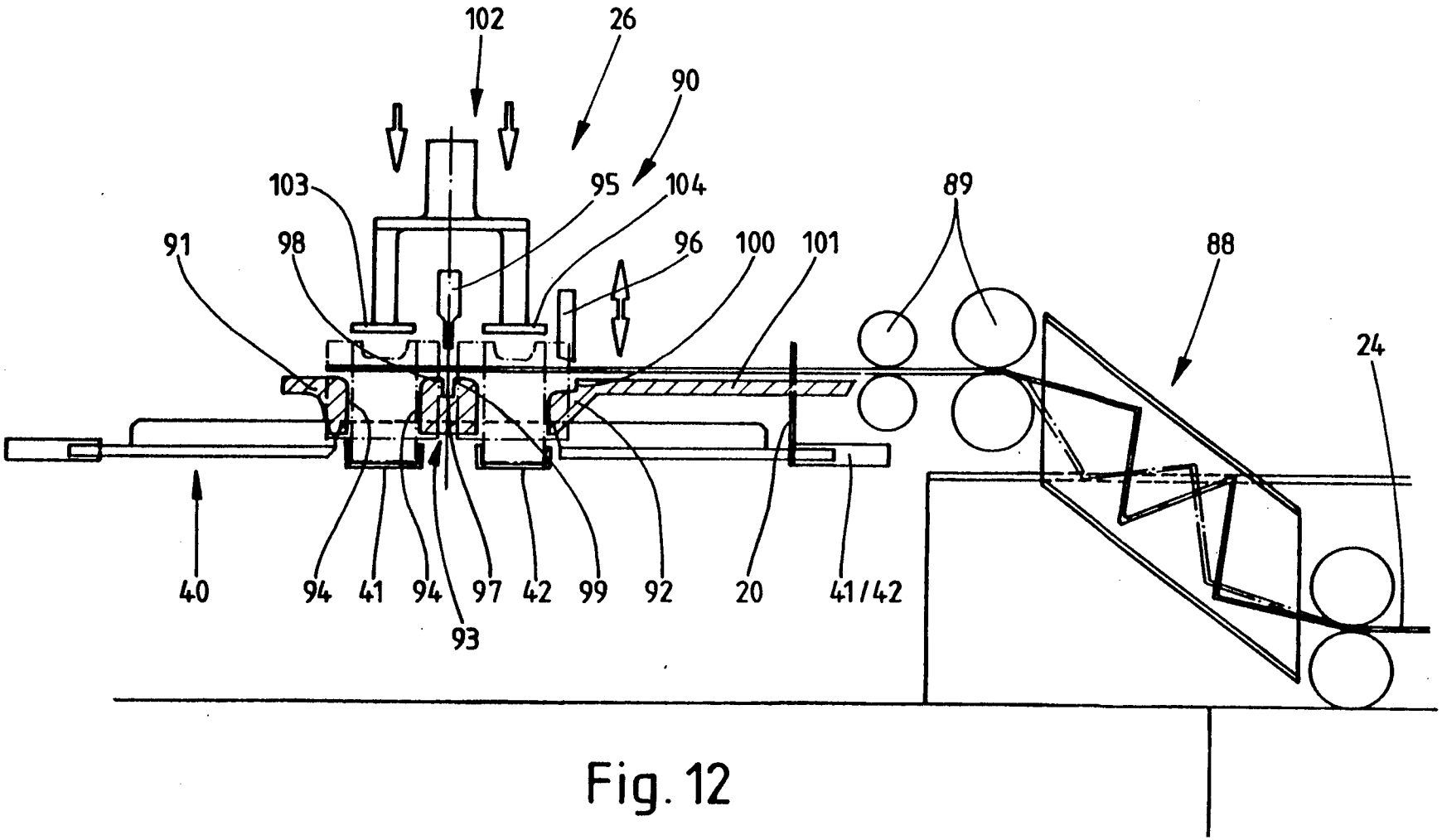
FIG. 12 shows a diagrammatic side view of a detail, namely the blank station of another version of the apparatus, on an enlarged scale.

An alternative version for forming individual blanks 20 or 20*a*, 20*b* by shearing from the web of material 24 is shown in FIG. 12.

In this exemplary embodiment, after leaving the compensating store 88 the web of material 24 is fed to the blank station 26 by means of conveying rollers 89.

A severing unit 90 is located in the blank station 26 immediately above the folding turret 40. The severing unit 90 consists of stationary guide bodies, namely lateral guides 91 and 92 and a middle guide 93. The above-mentioned guides are equipped with vertical sliding faces 94, on which, during the downward movement of the blanks 20*a*, 20*b*, lateral blank parts slide along and are folded into a vertical position, as already described in relation to the foregoing exemplary embodiment.

Shearing knives 95 and 96 also belong to the severing units 90. The middle shearing knife 95 is movable up and down in a vertical plane which corresponds to the severing plane between the two blanks 20*a*, 20*b* to be processed simultaneously. As a result of the downward movement of the shearing knife 95, in interaction with shearing edges 98 and 99 formed by a split 97 in the middle guide 93 the blanks 20*a*, 20*b* are severed from one another.

The severing of the two blanks 20*a*, 20*b* from the following web of material 24 is carried out by the shearing knife 96 in interaction with a fixed shearing edge 100 which is formed by a recess in the region of the lateral guide 92. The web of material 24 is fed to the severing unit 90 on this or on a plate 101 connected to the lateral guide 92.

The blank station 26 of this exemplary embodiment is assigned a double ram 102. During the downward movement out of the upper initial position shown in FIG. 12, its individual rams 103, 104 each grasp a blank 20*a*, 20*b* and move this through the guides 91, 92, 93 arranged in the manner of a mouthpiece and into the associated turret pocket 41, 42. In these, the blanks 20*a*, 20*b* are deposited in the already described folding position by the double ram 102.

Figure 13:
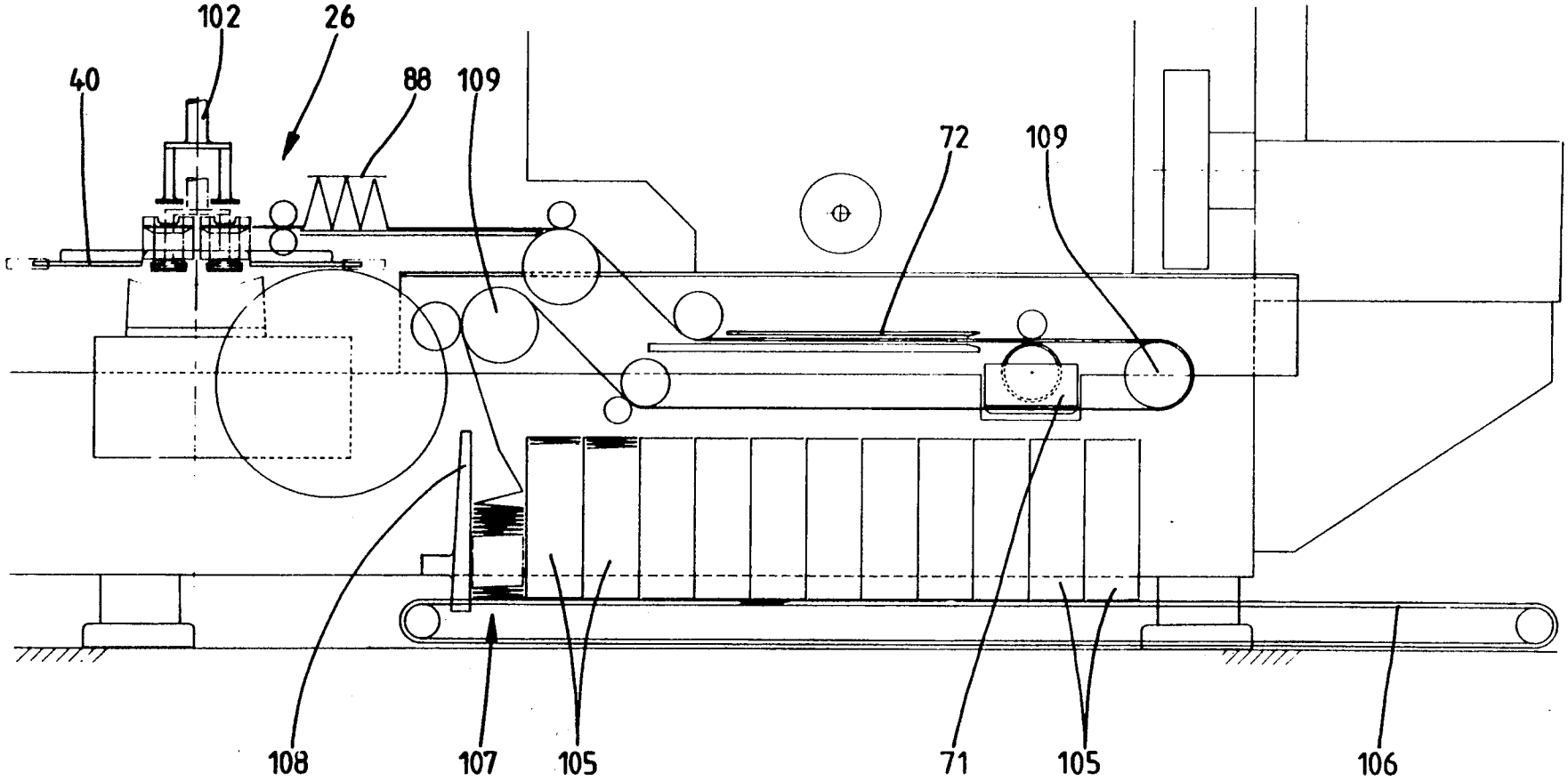
FIG. 13 shows a side view of a further examplary embodiment of an apparatus (packaging machine).

A further version of the apparatus (packaging machine) according to the invention is shown diagrammatically in FIG. 13. The blank station 26 is designed in the same way here as in the exemplary embodiment of FIG. 12. The special feature is the storage and feed of the web of material to the blank station 26

As can be seen, blank stacks 105 are formed as a stock. The blank stacks 105 are obtained as a result of the zigzag-shaped folding of a relatively long web of material. A large number of blanks 20 joined together can thereby be stored in a space-saving way. In the present exemplary embodiment, a plurality of blank stacks 105 are arranged closely next to one another on a common stack conveyor 106 designed as a conveyor band. The blank stacks 105 are conveyed successively into an extraction station 107. In the present exemplary embodiment, this is formed by a stationary vertical stop wall 108 for the particular front blank stack 105 to be reduced.

The web of material 24 is drawn off continuously from the blank stack 105 in the extraction station 107, the zigzag-shaped fold at the same time being eliminated. The web of material 24 is then conveyed via deflecting rollers 109 to the blank station 26.

The plurality of blank stacks 105 arranged in the material store, namely on the stack conveyor 106, are preferably formed from a common web of material 24 joined together. A lower blank 20 in each case of a blank stack 105 is connected to the upper blank 20 of the next following blank stack 105 via a web portion (not shown). The high-capacity store of blanks 20 can thus be used up as a result of a continuous reduction of the blank stacks 105 without any manual involvement. A new group of blank stacks 105 can then be placed on the stack conveyor 106.

What is claimed is:

1. An apparatus for the production of hinge lid packs from thin cardboard blanks (20) which are folded and filled in a rotatable folding turret (40), wherein:

each of the blanks (20) is of a generally rectangular configuration and has two long edges, and the blanks are interconnected with one another at their long edges to form a web (24);

the blanks (20) are interconnected solely by a line of residual connections (25);

said apparatus comprises, in a blank station (26), severing means for severing the blanks (20) from the web (24) an transferring them to said folding turret (40);

said apparatus further comprises feeding means for continuously feeding the web (24) to said blank station (26) while the blanks (20) are being severed from a stationary portion of the web in said blank station (26); and said apparatus further comprises, upstream of said blank station (26), a compensation store means (88) for temporarily storing the fed web (24) in a zig-zag configuration formed by the pivoting of adjacent pairs of blanks about the line of residual connections (25) to form included angles which vary during feeding of the web.

2. Apparatus according to claim 1, wherein said folding turret (40) has turret pockets (41, 42), which are open at a top side for receiving respective blanks (20), and is disposed below said blank station (26), wherein the severed blanks (20) are moved by a continuing downward movement into respective ones of said turret pockets (41, 42), and wherein the blanks (20; 20*a*, 20*b*) severed by said severing means (28) are introduced directly by means of pressure members (103, 104) into said turret pockets (41, 42) of the folding turret (40), and during the downward movement the blanks (20; 20*a*, 20*b*) are moved through guide bodies (91, 92; 93) which are arranged in the manner of a mouthpiece and by which lateral parts of the blanks are folded into a vertical position.

3. The apparatus according to claim 1, further comprising:

a folding track (72) through which the web (24) runs, the stationary folding members for folding edge parts of the blanks (20); (20*a*, 20*b*) in a region of said folding track (72); wherein said edge parts of the blanks are an inner tab (83) and a collar (21), said collar being connected to a blank by connection webs (22); and a lateral folding edge member (75) acting on a free lateral edge of the collar (21) so that the collar (21) is shifted relative to a blank as a result of the movement of the material web (24), the connection webs (22) at this same time being folded in a Z-shaped manner.

4. An apparatus for the production of hinge lid packs from thin cardboard blanks (20) which are folded and filled in a rotatable folding turret (40), wherein:

each of the blanks (20) is of a generally rectangular configuration and has two long edges, and the blanks are interconnected with one another at their long edges to form a web (24);

a collar (21) is connected to each blank (20) by webs (22) so that collars (21) of the interconnected blanks (20) are arranged at a border of the web (24); and said apparatus comprises: severing means (26), in a blank station (26), for severing the blanks from the web; upstream of said blank station (26), a folding track (72) and rollers (81, 82; 86, 87) for transporting the web (24) through said folding track (72); and folding means for folding the web in said folding track (72) and having a folding edge (75) for z-folding of said webs (22) of the collar (21).

5. An apparatus for the production of hinge lid packs form thin cardboard blanks (20) which are folded and filled in a rotatable folding turret (40), wherein:

each of the blanks (20) is of a generally rectangular configuration and has tow long edges, and the blanks are interconnected with one another at their long edges to form a web (24);

the blanks (20) are interconnected solely by a line of residual connections (25);

said apparatus comprises, in a blank station (26), severing means for severing the blanks (20) from the web (24) by severing the residual connections;

said severing means (28) comprises a stationary horizontal counterplate (32) and a severing ram means (29) which is movable up and down;

said folding turret (40) has turret pockets (41, 42), which are open at a top side for receiving respective blanks (20), and is disposed below said blank station (26);

the severed blanks (20) are moved by a continuing downward movement into respective ones of said turret pockets (41, 42); and for the simultaneous severing of at least two blanks (20*a*, 20*b*) from the web (24), said ram means (29) comprises two ram shearing plates (30, 31) movable in relation to said stationary horizontal counter plate (32) and a stationary shearing web (34) in such a way that two blanks (20*a*, 20*b*) are severed from the web (24) and from one another.

6. Apparatus according to claim 5, wherein said ram sharing plates (30, 31) hold the blanks, and wherein said apparatus further comprises means for moving apart said ram shearing plates to move the simultaneously severed blanks apart by a distance corresponding to a further packaging operation.

7. Apparatus according to claim 6, wherein said stationary shearing web (34) is arranged as a counter member between said ram plates (30, 31) in a plane between the two blanks (20*a*, 20*b*).

8. An apparatus for the production of hinge lid packs from thin cardboard blanks (20) which are folded and filled in a rotatable folding turret (40), wherein:

each of the blanks (20) is of a generally rectangular configuration and has two long edges, and the blanks are interconnected with one another at their long edges to form a web (24);

the blanks (20) are interconnected solely by a line o residual connections (25);

said apparatus comprises, in a blank station (26), severing means (28) for severing the blanks (20) from the web (24) by severing the residual connections;

said severing means (28) comprises a stationary horizontal counterplate (32) and a severing ram means (29) which is movable up and down;

said folding turret (40) has turret pockets (41, 42), which are open at a top side for receiving respective blanks (20), and is disposed below said blank station (26);

the severed blanks (20) are moved by a continuing downward movement into respective ones of said turret pockets (41, 42); and said apparatus further comprises: blank turret means (43) having a plurality of plane bearing faces (52), arranged in a polygonal manner, for the bearing of a blank (20*a*, 20*b*); and suction bores (44) for holding the blanks on said bearing surfaces (52).

9. Apparatus according to claim 8, wherein in a region of said bearing faces (52), said blank turret means (43) has recesses (48, 49) which have a width smaller than that of the blanks (20*a*, 20*b*) so that the blanks rest with edge regions thereof against said bearing faces (52) formed between said recesses (48, 49).

10. An apparatus for the production of hinge lid packs from thin cardboard blanks (20) which are folded and filled in a rotatable folding turret (40), wherein:

each of the blanks (20) is of a generally rectangular configuration and has two long edges, and the blanks are interconnected with one another at their long edges to form a web (24);

the blanks (20) are interconnected solely by a line of residual connections (25);

said apparatus comprises, in a blank station (26), severing means (28) for severing the blanks (20) from the web (24) by severing the residual connections;

said shearing means (28) comprises a stationary horizontal counterplate (32) and a severing ram means (29) which is movable up and down;

said folding turret (40) has turret pockets (41, 42), which are open at a top side for receiving respective blanks (20), and is disposed below said blank station (26);

the severed blanks (20) are moved by a continuing downward movement into respective ones of said turret pockets (41, 42); and a folding track (72) through which the web (24) runs, and stationary folding members for folding edge parts of the blanks (20); (20*a*, 20*b*) in a region of said folding track (72).

11. Apparatus according to claim 10, wherein the parts of the blanks (20; 20*a*, 20*b*) folded in the region of the folding track (72 are stabilized at the exit of the folding track (72) by means of pressure members in the form of pressure rollers (81, 82; 86, 87).

12. Apparatus according to claim 10, wherein said edge parts of the blanks are an inner tab (83) and a collar (21), said collar being connected to a blank by connection webs (22), and wherein said apparatus further comprises a lateral folding edge member (75) acting on a free lateral edge of the collar (21) so that the collar (21) is shifted relative to a blank as a result of the movement of the material web (24), the connection webs (22) at this same time being folding in a Z-shaped manner.

13. Apparatus according to claim 12, further comprising a counter-edge means (79) located opposite side folding edge member (75), for folding said inner tab (83) in a region of said folding track (72).

14. An apparatus for the production of hinge lid packs from thin cardboard blanks (20) which are folded and filled in a rotatable folding turret (40), wherein:

each of the blanks (20) is of a generally rectangular configuration and has tow long edges, and the blocks are interconnected with one another at their long edges to form a web (24);

the blanks (20) are interconnected by a line of residual connections (25);

said apparatus comprises:

in a blank station (26), severing means (28) for severing the blanks (20) from the web (24) by severing the residual connections;

a folding track (72) through which the web (24) runs, and stationary folding members for folding edge parts of the blanks (20); (20*a*, 20*b*) in a region of said folding track (72);

wherein said edge parts of the blanks are an inner tab (83) and a collar (21), said collar being connected to a blank by connection webs (22), and wherein said apparatus further comprises a lateral folding edge member (75) acting on a free lateral edge of the collar (21) so that the collar (21) is shifted relative to a blank as a result of the movement of the material web (24), the connection webs (22) at this same time being folded in a Z-shaped manner;

said apparatus further comprising a counter-edge means (79) located opposite side folding edge member (75), for folding said inner tab (83) in a region of said folding track (72);

wherein the parts of the blanks (20; 20*a*, 20*b*) folded in the region of the folding track (72) are stabilized at the exit of the folding track (72) by means of pressure members in the form of pressure rollers (81, 82; 86, 87).

15. An apparatus for the production of hinge lid packs from thin cardboard blanks (20) which are folded and filled in a rotatable folding turret (40), wherein:

each of the blanks (20) is of a generally rectangular configuration and has two long edges, an the blanks are interconnected with one another at their long edges to form a web (24);

the blanks (20) are interconnected solely by a line of residual connections (25);

said apparatus comprises, in a blank station (26), severing means for severing the blanks (20) from the web (24) and transferring them to said folding turret (40);

said apparatus further comprises feeding means for continuously feeding the web (24) to said blank station (26) while the blanks (20) are being severed from a stationary portion of the web in said blank station (26); and said apparatus further comprises:

a folding track (72) through which the web (24) runs, and stationary folding members for folding edge parts of the blanks (20); (20*a*, 20*b*) in a region of said folding track (72); wherein said edge parts of the blanks are an inner tab (83) and a collar (21), said collar being connected to a blank by connection webs (22); and a lateral folding edge member (75) acting on a free lateral edge of the collar (21) so that the collar (21) is shifted relative to a blank as a result of the movement of the material web (24), the connection webs (22) at this same time being folded in a Z-shaped manner.

16. An apparatus for the production of hinge lid packs from thin cardboard blanks (20) which are folded and filled in a rotatable folding turret (40), wherein:

each of the blanks (20) is of a generally rectangular configuration and has two long edges, and the blanks are interconnected with one another at their long edges to form a web (24);

the blanks (20) are interconnected solely by a line of residual connections (25);

said apparatus comprises, in a blank station (26), severing means for severing the blanks (20) from the web (24) and transferring them to said folding turret (40);

said apparatus further comprises feeding means for continuously feeding the web (24) to said blank station (26) while the blanks (20) are being severed form a stationary portion of the web in said blank station (26); and said apparatus further comprises:

a folding track (72) through which the web (24) runs, and stationary folding members for folding an inner tab (83) of each of the blanks (20); (20*a*, 20*b*) in a region of said folding track (72); and a lateral folding edge member (75) and an opposing counter-edge member (79) which fold said inner tab (83) in a region of said folding track (72).

* * * * *